US005477997A

United States Patent [19]

Weatherly

[11] Patent Number: 5,477,997

[45] Date of Patent: Dec. 26, 1995

[54] BRICK CARRIER TO BE WORN BY A BRICKLAYER

[76] Inventor: Ervin E. Weatherly, 1821 Pheasant Rd., Sumter, S.C. 29153

[21] Appl. No.: 283,040

[22] Filed: Jul. 28, 1994

[51] Int. Cl.[6] ..... E04G 21/16

[52] U.S. Cl. ..... 224/44.5; 224/197; 224/245; 224/224; 224/904; 220/478

[58] Field of Search ..... 224/191, 197, 224/199, 224, 226, 232, 242, 245, 252, 253, 904, 445, 225, 240, 198, 148, 270, 247, 248; 220/669, 671, 675, 478, 479

[56] References Cited

U.S. PATENT DOCUMENTS

| | | | |
|---|---|---|---|
| 299,573 | 6/1884 | Ord | 224/196 |
| 840,332 | 1/1907 | Howard et al. | 224/245 |
| 913,171 | 2/1909 | Smith | 224/226 |
| 1,109,161 | 9/1914 | Chindgren | 224/225 |
| 1,447,402 | 3/1923 | Anderson | 224/197 |
| 1,723,147 | 8/1929 | Fourethier | 224/197 |
| 2,630,651 | 3/1953 | McGee | 224/197 |
| 2,778,552 | 1/1957 | Thompson | 224/197 |
| 3,268,130 | 8/1966 | Simpson | 224/198 |
| 3,497,118 | 2/1970 | Najjar | 224/225 |
| 5,067,626 | 11/1991 | Leumi | 220/478 |
| 5,067,643 | 11/1991 | McKinney | 224/197 |
| 5,170,918 | 12/1992 | Perron | 224/225 |
| 5,294,030 | 3/1994 | Jollivette | 224/226 |

*Primary Examiner*—Henry J. Recla
*Assistant Examiner*—Gregory M. Vidovich
*Attorney, Agent, or Firm*—Michael A. Mann

[57] ABSTRACT

A device worn by a bricklayer for carrying bricks comprises a holder dimensioned to hold four bricks or more and, optionally, a belt with a detachable harness. The brick holder has a gap in front and in back for facilitating the grasping of the bricks or, alternatively, a plurality of spacing ribs to keep the bricks away from the interior of the holder so that the bricks can be grasped easily and removed. The holder may be attached to a belt through a belt loop or may include a swivel connection to enable the holder to pivot as necessary to prevent bricks from spilling. The holder is designed for use on the left or fight side of the bricklayer or both sides.

12 Claims, 3 Drawing Sheets

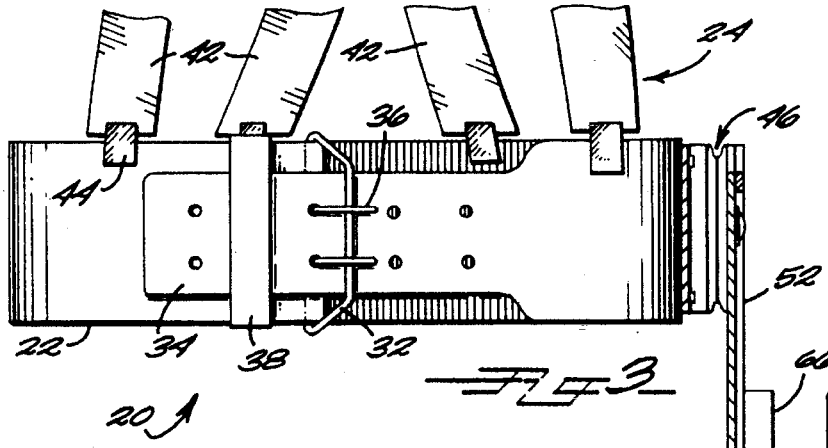
FIG 3
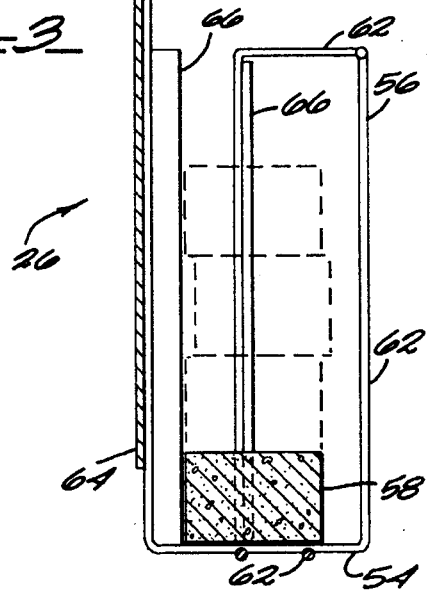
FIG 7
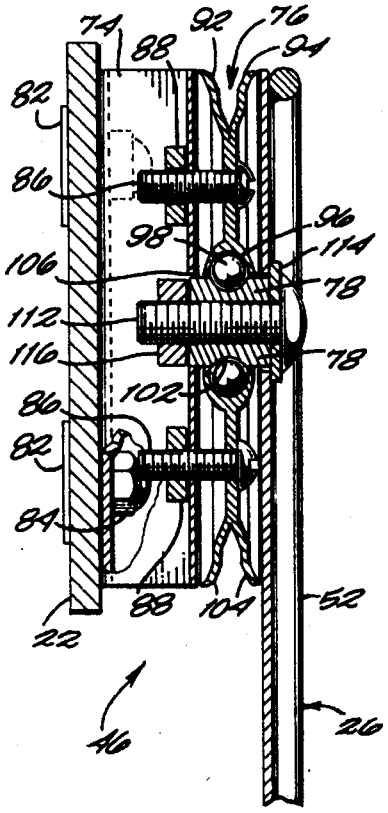
FIG 6
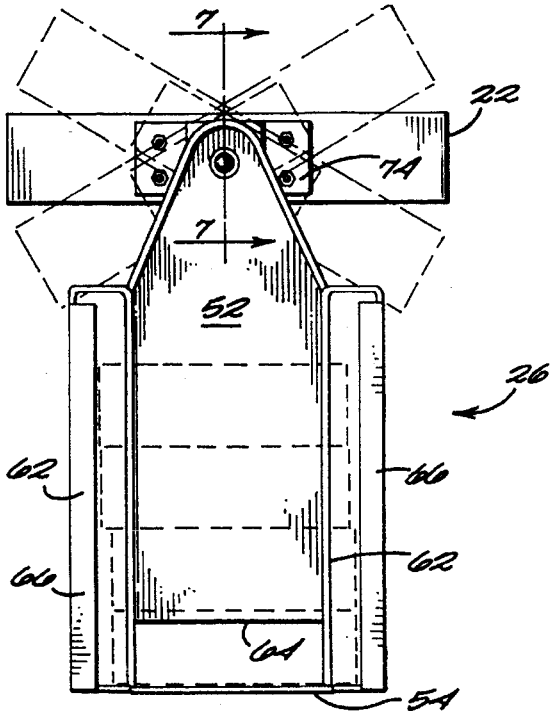

BRICK CARRIER TO BE WORN BY A BRICKLAYER

BACKGROUND OF THE INVENTION

1. Field of the Invention:

The present invention relates generally to devices for carrying a supply of workpieces. More specifically, the present invention is a device worn by a bricklayer for carrying a small supply of bricks.

2. Discussion of Background:

Bricklaying is an old art; bricks have been used in construction for five thousand years. Bricks are laid in courses by bricklayers who apply mortar to the brick to be laid and then position it against adjacent bricks, tapping it into place.

Bricklaying is not an easy task for a number of masons, but particularly because of the frequent bending to pick up bricks. Supplies of bricks are usually dumped on the ground at intervals along a course so that the bricklayer does not have to reach far for the next brick, but he or she still has to bend down to pick up each brick. This is the method used for thousands of years to lay bricks.

Because many bricklayers get paid based on the number of bricks laid or the completion of a job requiring a certain number of bricks, it is an economic necessity for bricklayers to minimize the transition time between positioning bricks. The current method of bending down to pick up each brick for positioning is inefficient.

Them are a number of devices for use in carrying various other supplies, tools or workpieces, but none are believed to exist for bricks. Many of these incorporate belts to which holders are secured. Some also have harnesses or vests that distribute the weight of the items held to the shoulders and back of the wearer. See for example the device described in U.S. Pat. No. 5,067,643 issued to McKinney. McKinney's hip level pack frame, suitable for holding newspapers or seedlings, is attached to a belt in such a way that it pivots as the wearer stoops. However, McKinney's device has bags that are not suitable for holding bricks.

Them remains a need for a device that helps a bricklayer to lay bricks by reducing the number of times a bricklayer must bend down to pick up bricks.

SUMMARY OF THE INVENTION

According to its major aspects and briefly stated, the present invention is a device worn by a bricklayer for carrying bricks. The device comprises a holder that can be worn on a belt, or a holder designed for a specific belt, and preferably worn with a detachable harness. In a preferred embodiment the holder is pivotally attached to the belt. The holder is dimensioned to carry at least four bricks. The interior surface of the brick holder is formed to enable the brick layer to grasp a brick either by gaps formed in its sides or by having a plurality of ribs attached to the sides to maintain a space between the bricks and the interior surface. Because of its pivotal connection to the belt, the holder pivots as the bricklayer bends to keep the holder level and prevent bricks from spilling out of the holder. Also, the holder is preferably wearable on either side of a belt for both left- and right-handed users or for wearing two holders. In the case of a pivotable holder, the inversion of the belt will cause the holder to rotate 180° for wearing by a left-handed bricklayer.

A major feature of the present invention is the means for enabling the grasping of the bricks, whether by providing a gap in the sides or by use of the spacing ribs within the brick holder. The advantage of this feature is that bricks carried within the holder can be grasped easily for removal regardless of how the bricks are stacked in the holder.

Another feature of the present invention is the deep belt loop in one embodiment of the present invention. This loop is deep enough to accommodate most back support belts that are used by those who do a lot of lifting either on the job or in exercising.

Another feature of the present invention is the detachable harness. The harness preferably comprises a pair of adjustable straps that clip on to either edge of the belt, thus providing additional support for carrying bricks. This feature transfers at least a portion of the weight of the bricks and the holder to the shoulders and back of the user. Also, when combined with the pivotally connected holder (discussed below), this feature allows the carrier to be "reversed" so that the holder is positioned on the opposing side of the user, if desired.

Still another feature of the present invention is the way the holder is pivotally connected to the belt. In particular, a curved plate is bolted to the belt and attached to a collar that has a rotatable sleeve. The brick holder is attached to the rotatable sleeve, thus allowing the holder and the sleeve to rotate with respect to the collar, the curved plate and the belt. The advantage of this feature is that the holder hangs vertically no matter how the belt is oriented. Therefore, bricks contained in the holder will not spill out during movement by the user.

Other features and advantages of the present invention will be apparent to those skilled in the bricklaying arts from a careful reading of the Detailed Description of Preferred Embodiments accompanied by the following drawings.

BRIEF DESCRIPTION OF THE DRAWINGS

In the drawings,

FIG. 6 is a side view of the holder showing the pivot ability of the holder with respect to the harness of the carrier;

FIG. 7 is a partial cross-sectional view of the holder taken along lines 7—7 of FIG. 6;

DETAILED DESCRIPTION OF PREFERRED EMBODIMENTS

Figures 1, 2, 3, 4, 5:
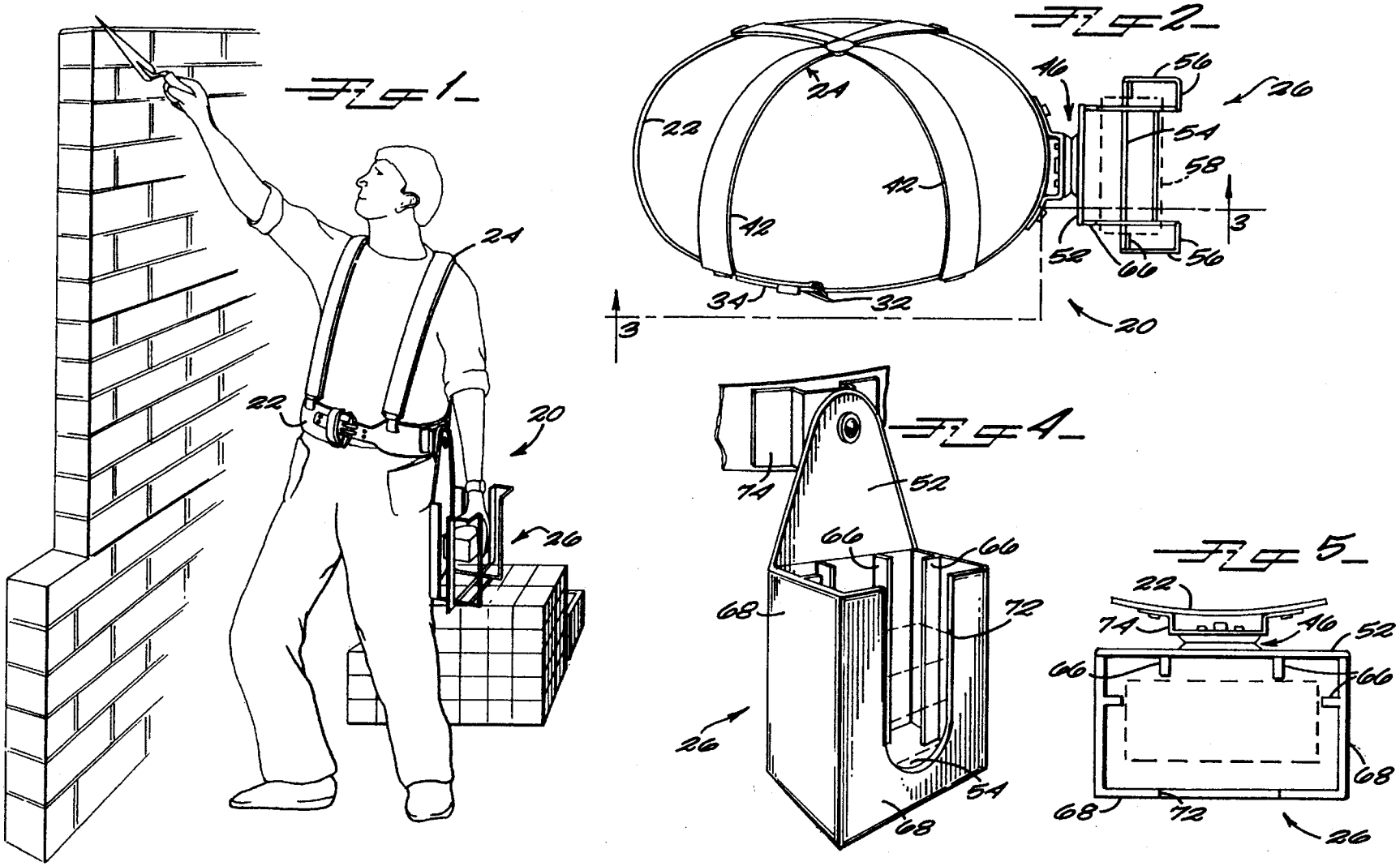
FIG. 1 is a perspective view of a brick carder according to a preferred embodiment of the present invention.
FIG. 2 is a plane view of a carrier according to a preferred embodiment of the present invention.
FIG. 3 is a front elevation of the carrier taken along lines 3—3 of FIG. 2.
FIG. 4 is a perspective view of a brick holder according to an alternative embodiment of the present invention.
FIG. 5 is a plane view of the alternative holder of FIG. 4.

In the following description similar components are referred to by the same reference numeral in order to simplify the understanding of the sequential aspect of the drawings.

Referring now to FIG. 1, the brick carder 20 as shown in use in its preferred embodiment is a belt 22, a harness 24, and a holder 26 for carrying bricks. Holder 26 is attached to belt 22, which is worn about the waist of the user in the manner shown. Also, harness 24 is connected to belt 22 and worn over the shoulders, crossing on the back, as shown.

Referring now to FIGS. 2–3, belt 22 is dimensioned to fit around the waist of the user and is made of a flexible yet substantially inelastic material such as leather or synthetic materials such as that known by the trademark KEVLAR. However, belt 22 is also rigid enough to provide support for the user and to support holder 26 and harness 24, both of which are attached to belt 22.

Preferably, belt 22 has a buckle 32 or other means for adjusting the fit of belt on the user. As is well known, buckle 32 is used in conjunction with a flap or tongue 34 having perforations therein for receiving one or more members 36 in order to adjust the fit of belt 32. A loop 38 keeps tongue 34 positioned against belt 22.

Harness 24 is preferably a pair of suspender-like straps 42 that are releasably attached to belt 22 using clips 44, or alternatively, snaps, or buttons. Straps 42 may intersect, as shown in FIG. 3, and can be adjusted for improved fit to the user. In the preferred embodiment, straps 42 are clipped to belt 22 using clips 44 so that harness 24 distributes and, to a certain extent, transfers the weight of carrier 20 to the shoulders and back of the user. Thus, straps 42 must be made of a material sufficiently strong to support both belt 22 and holder 26 and wider rather than narrower for comfort. Similarly, clips 44 must have sufficient strength to remain clipped to belt 22.

Holder 26 is pivotally attached to belt 22 by a connector 46 that is discussed in greater detail below. Holder 26 has a rigid back 52, a bottom 54, and sides 56 that collectively define an interior area of holder 26 that is dimensioned to receive and carry at least four bricks 58. Bricks 58 are preferably stacked within holder 26, as shown in FIG. 3, although it is within the scope of this invention to modify the shape of holder 26 to accommodate an alternate arrangement of bricks within holder 26 such as an array or a combination of both.

In the preferred embodiment, back 52 of holder 26 is a flat plate made of steel or other suitable material. Bottom 54 and sides 56 of holder 26 are formed by a plurality of rods 62. Rods 62 are preferably made of steel or other similar material that can withstand the rigors of carrying bricks 58 during the use of carrier 20.

At least two of rods 62 extend outward from a lower end 64 of back 52 to form bottom 54 of holder 26. Also, a plurality of rods 62 extend upward away from bottom 54 to form sides 56 of holder 26. Additional rods can be connected to rods 62 at the top of sides 56 (as shown best in FIG. 1), but need not be.

A plurality of ribs 66 are connected to holder 26 and extend or project into the interior area of holder 26 so that, when bricks 58 are carried by holder 26, a space is formed between bricks 58 and holder 26 so that bricks 58 can be grasped easily by the user. Preferably, ribs 66 are oriented vertically at one or more positions along back 52 and sides 56 to project slightly into the interior area of holder 26. Also, because sides 56 of holder 26 are preferably defined by rods 62 rather than solid walls, for example, there is sufficient space in holder 26 to further facilitate grasping of bricks 58 carried therein.

An alternative embodiment of holder 26 is shown in FIGS. 4-5. In this embodiment, holder 26 is formed by back 52, bottom 54, and a plurality of side walls 68. Side walls 68 can be made of any suitable material capable of withstanding the rigors of using holder 26 to carry bricks 58. Preferably, side walls 68 are made of a light but durable material so that side walls 68 contribute as little as possible to the overall weight of carrier 20 such as injection-molded plastic, for example, engineering-grade nylon.

In this alternative embodiment, ribs 66 extend or project inward from back 52 and side walls 68 (shown best in FIG. 5) to maintain adequate spacing between side walls 68 and the one or more bricks 58 carried within holder 26. Unlike the previous embodiment, in which sides 56 are formed by rods 62, holder 26 does not have as much open area and is more confined in terms of allowing the user to reach in and grasp one of bricks 58 for removal from holder 26. Therefore, a cut out portion 72 is formed in one or more side walls 68 to provide more room for the user to grasp bricks 58 and remove them from holder 26.

As shown in FIG. 6, holder 26 is pivotally connected to belt 22 so that holder 26 hangs vertically from belt 22. In this manner, holder 26 remains in a satisfactory operating position regardless of the position of belt 22. Thus, the user is free to bend and other, vise move around freely during the course of his or her work without concern that any of the bricks 58 might fall from holder 26.

Also, because harness 24 is removably attached to belt 22 and the holder can pivot 180°, carrier 20 can be inverted for use by a left-handed bricklayer. Harness 24 is then reattached to the new "upper" edge of belt 22. That is, to orient carrier 20 so that holder 26 is on the opposing side of the user, harness 24 is removed from belt 22, belt 22 is turned over and holder 26 is inverted simultaneously using its pivotal connection with belt 22. Then, harness 24 is clipped onto the "new" top side of belt 22. In this manner, when carrier 20 is worn by the user, holder 26 hangs down frown the opposing side of the user.

Holder 26 is pivotally connected to belt 22 using connector 46, which is shown in detail in FIG. 7. Preferably, connector 46 comprises a curved plate 74 in combination with a collar 76 having a rotatable sleeve 78.

Curved plate 74 is attached to one side of belt 22 by appropriate means, as shown best in FIG. 1. Because of the positioning of curved plate 74 along belt 22 when attached thereto, the shape of curved plate 74 preferably simulates the curve of belt 22 to the hip when worn. Preferably, as shown in FIG. 7, curved plate 74 is connected to belt 22 using a flat-headed bolt 82 in combination with a nut 84.

A collar 76 is attached by appropriate means to curved plate 74, preferably using a pair of bolts 86 and nuts 88. Collar 76 has a first face 92 and a second face 94 joined together to form a bearing housing 96 having a plurality of ball bearings 98 therein. Bearing housing 96 has a sleeve 78 disposed therethrough, as shown. A channel or groove 102 is formed in sleeve 78 for engagement with ball bearings 98, thus allowing sleeve 78 to rotate freely with bearing housing 96.

As shown, the length of sleeve 78 is slightly greater than the width of collar 76 and therefore sleeve 78 extends just beyond the planes defining the edges 104 of collar 76. Therefore, when holder 26 is fixably attached to curved plate 74, as shown, sleeve 78 extends through a hole 106 formed in curved plate 74. Also, the configuration of sleeve 78 within collar 76 allows holder 26 to be fixably connected to sleeve 78 so that holder 26 and sleeve 78 rotate with respect to collar 76, curved plate 74, and belt 22. Holder 26 is preferably connected to sleeve 78 using a large bolt 112, washer 114 and nut 116 arrangement as shown. Other suitable connecting devices that are freely rotatable and yet can secure a holder of bricks to a belt can be used as well.

Figure 8:
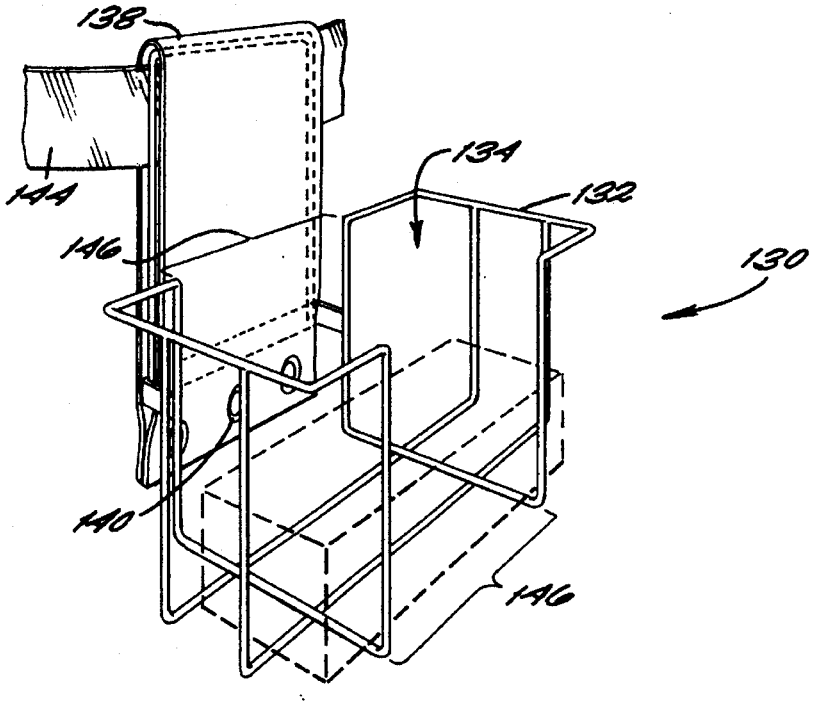
FIG. 8 is a perspective view of an alternative embodiment of the present invention.
Figure 9:
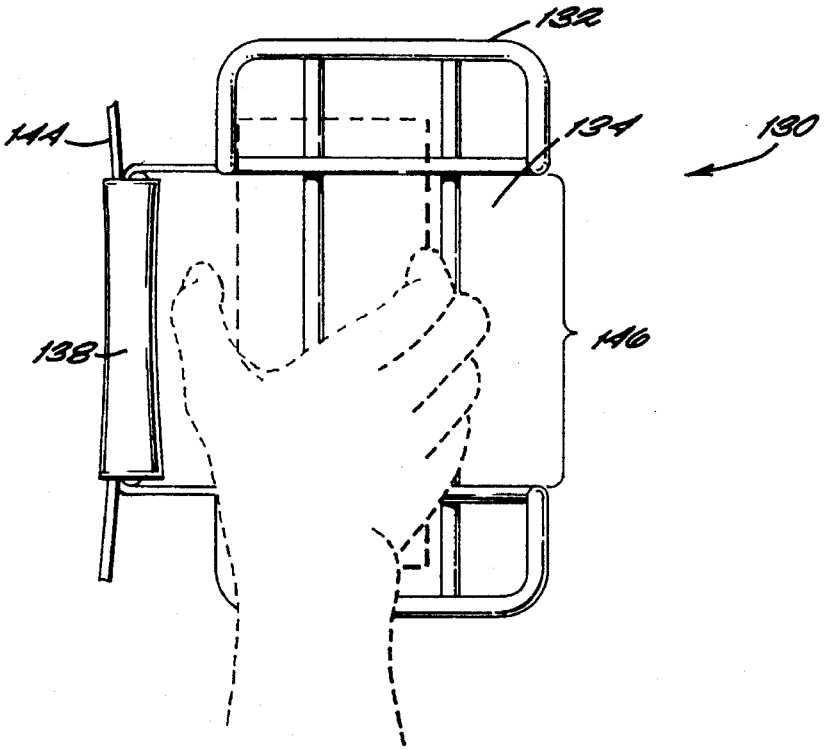
FIG. 9 is a top view of the alternative embodiment shown in FIG. 8.

An alternative embodiment according to the present invention is illustrated in FIGS. 8 and 9. This embodiment is somewhat simpler and potentially lighter in weight, and to that extent, may be preferred, although the holder used in this embodiment does not have the capability of swiveling. This embodiment includes a holder 130 formed as a cage of sorts from a plurality of rods 132. Holder 130 thus defines a confined volume 134 that can accommodate a number of bricks. A belt loop 138 is fastened to holder 130 using one or more grommets 140. Belt loop 138 is preferably tough, but flexible and both wide and deep so as to receive a wide belt 144, suggested in FIG. 8, of the type commonly used by someone to provide back support for lifting, whether that lifting is in the course of performing a job or in exercising. Such belts are customarily approximately at least four inches wide.

Although no swivel mechanism is provided, some rotation of holder 130 as the user bends is inherent because of the flexibility of the material of loop 138 and because it is not secured rigidly to belt 144.

Importantly, in the formation of holder 130, gaps 146 are provided between some of rods 132, preferably in the front and back of holder 130 for the user to grasp the next brick. As illustrated, a brick 146 will be held within holder 130, but a user can grasp brick 146 between a thumb and the opposing fingers, the thumb coming through the gap at the back of the holder and the opposing fingers coming through the gap at the front of the holder.

The use of rods 132, preferably steel rods, provides a rigid holder 132 with minimum weight. Therefore, it will be easier to use two such holders. Also, holder 130 will not trap din or bits of brick.

In use, holder 26 is connected to belt 22 using connecting arrangement 46 in the manner described previously. Belt 22 is then oriented so that holder 26 hangs from the desired side of belt 22. For example, a right-handed user may desire holder 26 to hang from his or her left side, as shown in FIG. 1. Finally, harness 24 is clipped to the "upper" edge of belt 22.

The user then wears carder 20 as shown in FIG. 1. Harness 24 and belt 22 (using buckle 32) are both adjusted for comfort to the user. Belt 22 should fit comfortably around the waist of the user, but be snug enough to prevent holder 26 from causing belt 22 to sag to one side. Also, straps 42 of harness 24 should be adjusted so that belt 22 is supported properly.

Alternatively, a second holder (not shown) can be pivotally connected to belt 22 in the same manner as described above. A dual-holder carrier of this type can be used, for example, by assistant bricklayers, whose primary task is to maintain a steady supply of bricks for the primary bricklayer so that the primary bricklayer does not have to spend time gathering bricks to work with.

In operation, carrier 20, once secured to the user as shown in FIG. 1, is filled with at least four bricks 58 and preferably five or six. The user then has at least four bricks 58 to work with before he or she must bend down to get more bricks. Once all of the bricks 58 in holder 26 have been laid, the user refills holder 26 with at least four more bricks 58.

Using carrier 20 in this manner, the user has significantly reduced the time and hardship required in reaching down to get one brick at a time to work with. That is, using carrier 20, the user only has to bend down and get bricks once for every group of four or more bricks that are laid.

It will be apparent to those skilled in the art that many changes and substitutions can be made to the preferred embodiment herein described without departing from the spirit and scope of the present invention as defined by the appended claims.

What is claimed is:

1. A device for carrying bricks, said device comprising:

a belt;

a harness attached to said belt;

a holder attached to said belt and having an inner surface, said inner surface of said holder dimensioned to hold said bricks, said holder having means formed therein for spacing said bricks apart from said inner surface of said holder;

a plate, said plate having curved end portions being connected to said belt and a flat portion intermediate said end portions having a hole therein and being located adjacent said belt;

a sleeve rotatably disposed within said hole: and means for fixably attaching said holder to said sleeve so that said holder rotates with respect to said flat portion of said plate.

2. The apparatus as recited in claim 1, wherein said spacing means includes a plurality of ribs projecting from said inner surface.

3. The apparatus as recited in claim 1, wherein said holder further comprises:

a back having an upper end attached to said belt and an opposing lower end;

a bottom attached to said lower end of said back; and a plurality of sides attached to said bottom.

4. The apparatus as recited in claim 1, wherein said harness further comprises a pair of shoulder straps connected to said belt.

5. The apparatus as recited in claim 1, wherein said harness further comprises shoulder straps detachably connected to said belt.

6. The apparatus as recited in claim 1, wherein said holder is dimensioned to carry at least four bricks.

7. A device for carrying bricks, said device comprising a holder having an interior, a front and a back, and dimensioned to hold said bricks within said interior, said holder having gaps formed in said front and said back so that a user can grasp bricks in said holder, and means connected to said holder for pivoting said holder about an axis perpendicular to the plane of said back of said holder.

8. A device for carrying bricks, said device comprising:

a belt;

a shoulder harness detachably connected to said belt;

a holder having an interior, a bottom and sides, and dimensioned to hold said bricks;

a plurality of ribs projecting from said sides of said holder for spacing said bricks apart from said sides of said holder when said bricks are in said interior of said holder;

a plate, said plate having curved end portions being connected to said belt and a flat portion intermediate said end portions having a hole therein and being located adjacent said belt;

a collar fixably attached to said plate, said collar having a bearing housing defining a port in alignment with said hole;

a sleeve rotatably disposed within said port, said bearing housing allowing said sleeve to rotate within said hole when said collar is fixably attached to said curved plate; and bolt means for fixably attaching said holder to said sleeve so that said holder and said sleeve rotate with respect to said curved plate.

9. The apparatus as recited in claim 8, wherein said shoulder harness further comprises straps that are releasably clipped to said belt.

10. The apparatus as recited in claim 8, wherein said holder further comprises:

a back having an upper end pivotally attached to said connecting means and an opposing lower end; and a plurality of rods extending a first distance outward from said lower end of said back to form said bottom and extending upward from said bottom a second distance to form said sides.

11. The apparatus as recited in claim 8, wherein said holder further comprises at least one side having a cut out portion to facilitate grasping said bricks.

12. The apparatus as recited in claim 8, wherein said belt further comprises means for buckling said belt.

* * * * *